US007869896B2

(12) United States Patent
Yamada et al.

(10) Patent No.: US 7,869,896 B2
(45) Date of Patent: Jan. 11, 2011

(54) TANGENTIAL GRINDING RESISTANCE MEASURING METHOD AND APPARATUS, AND APPLICATIONS THEREOF TO GRINDING CONDITION DECISION AND WHEEL LIFE JUDGMENT

(75) Inventors: Yasuhira Yamada, Tokoname (JP); Hiroshi Morita, Hoi-gun (JP)

(73) Assignee: JTEKT Corporation, Osaka-shi (JP)

( * ) Notice: Subject to any disclaimer, the term of this patent is extended or adjusted under 35 U.S.C. 154(b) by 691 days.

(21) Appl. No.: 11/837,781

(22) Filed: Aug. 13, 2007

(65) Prior Publication Data

US 2008/0051006 A1 Feb. 28, 2008

(30) Foreign Application Priority Data

Aug. 24, 2006 (JP) ..... 2006-227618
Aug. 24, 2006 (JP) ..... 2006-227754

(51) Int. Cl.

| | |
|---|---|
| ***G06F 19/00*** | (2006.01) |
| ***B24B 49/00*** | (2006.01) |
| ***B24B 51/00*** | (2006.01) |
| *G11B 5/127* | (2006.01) |
| *H04R 31/00* | (2006.01) |
| *B23P 15/06* | (2006.01) |

(52) U.S. Cl. ..... 700/164; 700/159; 700/160; 700/172; 700/175; 451/1; 451/5; 264/162; 29/603.15; 29/888.075

(58) Field of Classification Search ..... 700/159–160, 700/164, 172, 175; 451/1, 5; 264/162; 29/603.15, 29/888.075

See application file for complete search history.

(56) References Cited

U.S. PATENT DOCUMENTS

| | | | | |
|---|---|---|---|---|
| 3,653,855 | A * | 4/1972 | Smith | 451/11 |
| 3,810,002 | A * | 5/1974 | Sata | 324/236 |
| 4,071,980 | A | 2/1978 | Kubo | |
| 5,018,071 | A * | 5/1991 | Kihara et al. | 700/164 |
| 5,291,691 | A * | 3/1994 | Unno et al. | 451/56 |
| 5,913,994 | A * | 6/1999 | Avril et al. | 156/173 |
| 6,113,474 | A * | 9/2000 | Shih et al. | 451/72 |
| 6,117,001 | A * | 9/2000 | Enomoto et al. | 451/541 |
| 6,128,547 | A * | 10/2000 | Tomoeda et al. | 700/170 |
| 6,572,444 | B1 * | 6/2003 | Ball et al. | 451/10 |
| 2006/0073765 | A1 * | 4/2006 | Noda | 451/5 |

FOREIGN PATENT DOCUMENTS

| | | |
|---|---|---|
| JP | 57-132970 | 8/1982 |
| JP | 4-315571 | 11/1992 |
| JP | 11-10535 | 1/1999 |
| JP | 2003-25223 | 1/2003 |

* cited by examiner

*Primary Examiner*—Ramesh B Patel
(74) *Attorney, Agent, or Firm*—Oblon, Spivak, McClelland, Maier & Neustadt, L.L.P.

(57) ABSTRACT

A tangential grinding resistance measuring method includes obtaining an abrasive grain section area which is at a predetermined infeed depth from the highest top surface of abrasive grains on a grinding wheel; calculating the tangent of a half vertex angle of a conical model for cutting edges of the abrasive grains which model takes the abrasive grain section area as its bottom surface and the predetermined depth as its height; setting grinding parameters; and calculating a tangential grinding resistance from the grinding parameters and the tangent.

16 Claims, 7 Drawing Sheets

FIG. 5
| | a1 | a2 | a3 | a4 | a5 | a6 | a7 | a8 | a9 | a10 |
|---|---|---|---|---|---|---|---|---|---|---|
| b1 | | | | | | | | | | |
| b2 | | | | | | | | | | |
| b3 | | | | | | | | | | |
| b4 | | | | | | | | | | |
| b5 | | | | | | | | | | |
| b6 | | | | | | | | | | |
| b7 | | | | | | | | | | |
| b8 | | | | | | | | | | |
| b9 | | | | | | | | | | |
| b10 | | | | | | | | | | |
FIG. 6
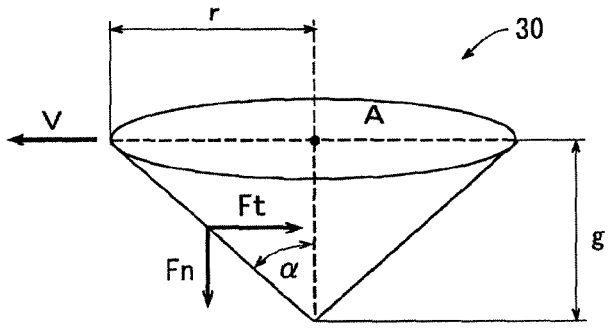
FIG. 7
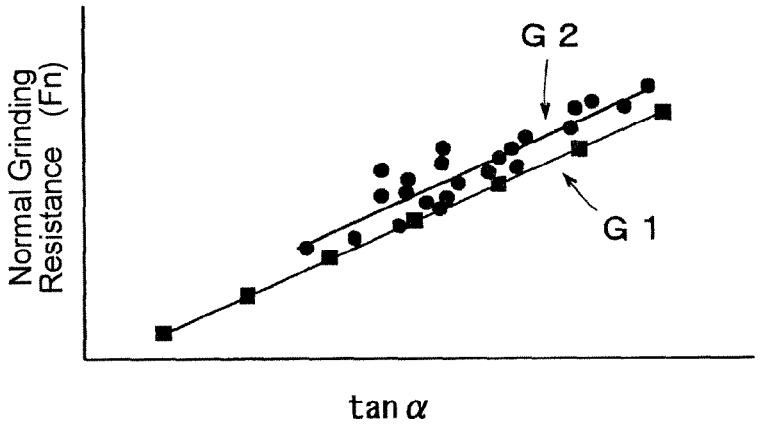

TANGENTIAL GRINDING RESISTANCE MEASURING METHOD AND APPARATUS, AND APPLICATIONS THEREOF TO GRINDING CONDITION DECISION AND WHEEL LIFE JUDGMENT

INCORPORATION BY REFERENCE

This application is based on and claims priority under 35 U.S.C. 119 with respect to Japanese patent applications No. 2006-227618 and No. 2006-227754 both filed on Aug. 24, 2006, the entire contents of which are incorporated herein by reference.

BACKGROUND OF THE INVENTION

1. Field of the Invention

The present invention relates to a tangential grinding resistance measuring method and apparatus for a grinding wheel in which a grinding wheel layer having abrasive grains bonded with a bond material is formed on a grinding surface. It also relates to a grinding condition decision method and apparatus and a wheel life judgment method and apparatus for such a grinding wheel which are practiced by utilizing the tangential grinding resistance measuring method and apparatus.

2. Discussion of the Related Art

Heretofore, for deciding a grinding condition for a grinding wheel in which a grinding wheel layer having abrasive grains bonded with a bond material is formed on an outer circumferential surface of a disc-like core member, there has been implemented a method in which a worker evaluates grinding burns on a workpiece after actual grinding of the same and sets another grinding condition again if a predetermined standard is not satisfied. However, this grinding condition decision method relies on try and error in setting a grinding condition and hence, requires a long time. It also relies on worker's experiences in setting the grinding condition and is liable to make the grinding condition fluctuate or vary in dependence on workers.

On the other hand, there has been proposed a grinding condition decision method described in Japanese unexamined, published patent application No. 4-315571. This grinding condition decision method will be described hereafter. First of all, tolerances for at least one of a normal grinding resistance and a tangential grinding resistance as well as for the ratio therebetween are set in advance. A normal grinding resistance and a tangential grinding resistance are measured during a grinding operation, and a ratio therebetween is calculated. Then, where the ratio is within the tolerance, the tolerance and the measured value of at least one of the normal grinding resistance and the tangential grinding resistance are compared to decide a grinding condition.

However, in the grinding condition decision method described in the aforementioned Japanese application, the relation between the tolerances and the grinding burn is indefinite, and it is hard to say that the evaluation of the grinding burn is satisfactory.

Heretofore, there has been known a wheel life judgment apparatus described in Japanese unexamined, published patent application No. 11-10535. The wheel life judgment apparatus is of the character that a wheel life is judged by measuring ultrasonic waves of an extremely high frequency (i.e., acoustic emissions) which are emitted when abrasive grains are crushed. According to the wheel life judgment apparatus, the wheel life can be judged based on the correlation which seems to exist between the crush of the abrasive grains and the magnitude of the acoustic emissions.

Further, there has also been known another wheel life judgment apparatus described in Japanese unexamined, published patent application No. 2003-25223. The wheel life judgment apparatus is of the character that a wheel life is detected by measuring an irregularity (an undulation on a grinding surface) which is formed by a part of the abrasive grain surface with pores having been stuffed and another part thereof with pores not having been stuffed. According to the wheel life judgment apparatus, the wheel life can be judged based on the correlation which seems to exist between the crush of the abrasive grains and the dimension of the undulation on the grinding surface.

However, the wheel life judgment apparatus described in the last mentioned two Japanese applications are to make a judgment in dependence on the magnitude of the acoustic emissions or the dimension of the undulation on the grinding surface, but are not to make a judgment based on a tangential grinding resistance which is directly concerned with the wheel life. Therefore, in the wheel life judgment apparatus, the wheel life cannot necessarily be judged precisely.

SUMMARY OF THE INVENTION

It is therefore a primary object of the present invention to provide a tangential grinding resistance measuring method and apparatus for a grinding wheel capable of measuring the tangential grinding resistance on the grinding wheel precisely.

Another object of the present invention is to provide a grinding condition decision method and apparatus capable of deciding a hard-to-vary grinding condition within a short period of time and also capable of suppressing the occurrence of grinding burns by utilizing the tangential grinding resistance measuring method and apparatus.

A further object of the present invention is to provide a wheel life judgment method and apparatus capable of judging the wheel life precisely by utilizing the tangential grinding resistance measuring method and apparatus.

Briefly, according to a first aspect of the present invention, there is provided a tangential grinding resistance measuring method and apparatus for a grinding wheel in which a grinding wheel layer having abrasive grains bonded with a bond material is formed on a grinding surface. The measuring method and apparatus comprises a section area obtaining step and means for obtaining an abrasive grain section area which is at a predetermined depth from the highest top surface of a plurality of abrasive grains within a predetermined area on a grinding surface of the grinding wheel; a tangent calculation step and means for assuming a conical model for cutting edges of the abrasive grains within the predetermined area, the conical model taking the abrasive grain section area as its bottom surface and the predetermined depth as its height, and for calculating a tangent of a half vertex angle which is half of a vertex angle of the conical model; a parameter setting step and means for setting grinding parameters; and a tangential grinding resistance calculation step and means for calculating a tangential grinding resistance from the grinding parameters and the tangent.

In the tangential grinding resistance measuring method and apparatus in the first aspect of the present invention, an assumption is made of the conical model for cutting edges of the plurality of abrasive grains which model takes as its bottom surface the abrasive grain section area at the predetermined depth from the highest top surface of the abrasive grains and as its height the predetermined depth, and a normal grinding resistance which is calculated from the tangent of the half vertex angle and the grinding parameters well coincides with an actually measured value therefor. For this reason, it seems that the tangential grinding resistance which can be calculated from the normal grinding resistance based on the conical model also well coincides with an actually measured value therefor. Therefore, in the tangential grinding resistance measuring method and apparatus, it is possible to judge the wheel life precisely.

In a second aspect of the present invention, there is provided a grinding condition decision method and apparatus using the tangential grinding resistance measuring method and apparatus in the first aspect of the present invention. The tangential grinding resistance is calculated by the tangential grinding resistance measuring method and apparatus. The grinding condition decision method and apparatus further comprises a grinding heat amount calculation step and means for calculating a grinding heat amount from the tangential grinding resistance; a maximum temperature calculation step and means for calculating a maximum temperature at a grinding point from the grinding heat amount; a grinding burn judgment step and means for judging the occurrence of grinding burn by the comparison of the maximum temperature with a threshold value; and a grinding condition decision step and means for deciding whether or not a grinding condition which is established based on the grinding parameters set by the parameter setting step and means is acceptable, based on a judgment made by the grinding burn judgment step and means.

With this construction, since the grinding condition is determined so that the maximum temperature obtained through the aforementioned predetermined steps and means becomes equal to or less than the threshold value, it can be realized to decide the grinding condition without relying on any of try and error and worker's experiences. Further, the tangential grinding resistance which is calculated from the tangent of the half vertex angle of the conical model and the grinding parameters well coincides with an actually measured value therefor. For this reason, it seems that the tangential grinding resistance, the grinding heat amount and the maximum temperature which can be calculated from a normal grinding resistance based on the conical model well coincide with actually measured values therefor. Therefore, in the grinding condition decision method and apparatus, it is possible to decide a hard-to-vary grinding condition within a short period of time and to suppress the occurrence of grinding burns.

In a third aspect of the present invention, there is provided a wheel life judgment method and apparatus using the tangential grinding resistance measuring method and apparatus in the first aspect of the present invention. The tangential grinding resistance is calculated by the tangential grinding resistance measuring method and apparatus. The wheel life judgment method and apparatus further comprises a wheel life judgment step and means for judging the wheel life of the grinding wheel by the comparison of the tangential grinding resistance with a threshold value.

In the wheel life judgment method and apparatus in the third aspect of the present invention, the tangential grinding resistance is calculated by the tangential grinding resistance calculation method and apparatus from the grinding parameters and the tangent. Since the wheel life is then judged by the wheel life judgment step and means based on the tangential grinding resistance, it can be done to judge the wheel life precisely.

In a fourth aspect of the present invention, there is provided a wheel life judgment method and apparatus for a grinding wheel in which a grinding wheel layer having abrasive grains bonded with a bond material is formed on a grinding surface. The wheel life judgment method and apparatus in the fourth aspect comprises a section area obtaining step and means for obtaining an abrasive grain section area which is at a predetermined depth from the highest top surface of a plurality of abrasive grains within a predetermined area on a grinding surface of the grinding wheel; and a wheel life judgment step and means for judging the wheel life of the grinding wheel by the comparison of the abrasive grain section area with a threshold value.

In the wheel life judgment method and apparatus in the fourth aspect of the present invention, the abrasive grain section area which is at the predetermined depth from the highest top surface of the plurality of the abrasive grains is obtained by the section area obtaining step and means, and the wheel life is judged by the wheel life judgment step and means by the comparison of the abrasive grain section area with the threshold value. Thus, it can be done to judge the wheel life without calculating a tangential grinding resistance. Where the grinding parameters are fixed in a conical model, the half square of the abrasive grain section area is in proportion to the tangential grinding resistance. Therefore, where the grinding parameters are fixed to conventional values, the wheel life can be judged precisely by the use of the abrasive grain section area.

BRIEF DESCRIPTION OF THE ACCOMPANYING DRAWINGS

The foregoing and other objects and many of the attendant advantages of the present invention may readily be appreciated as the same becomes better understood by reference to the preferred embodiments of the present invention when considered in connection with the accompanying drawings, wherein like reference numerals designate the same or corresponding parts throughout several views, and in which:

FIG. 5 is a representation of a data group representing a three dimensional shape of a surface on a grinding wheel chip;

FIG. 6 is a perspective view showing a conical model for abrasive grain cutting edges;

FIG. 7 is a graph showing the relation between tangent of a half vertex angle of the abrasive grain cutting edge and normal grinding resistance;

Figure 8:
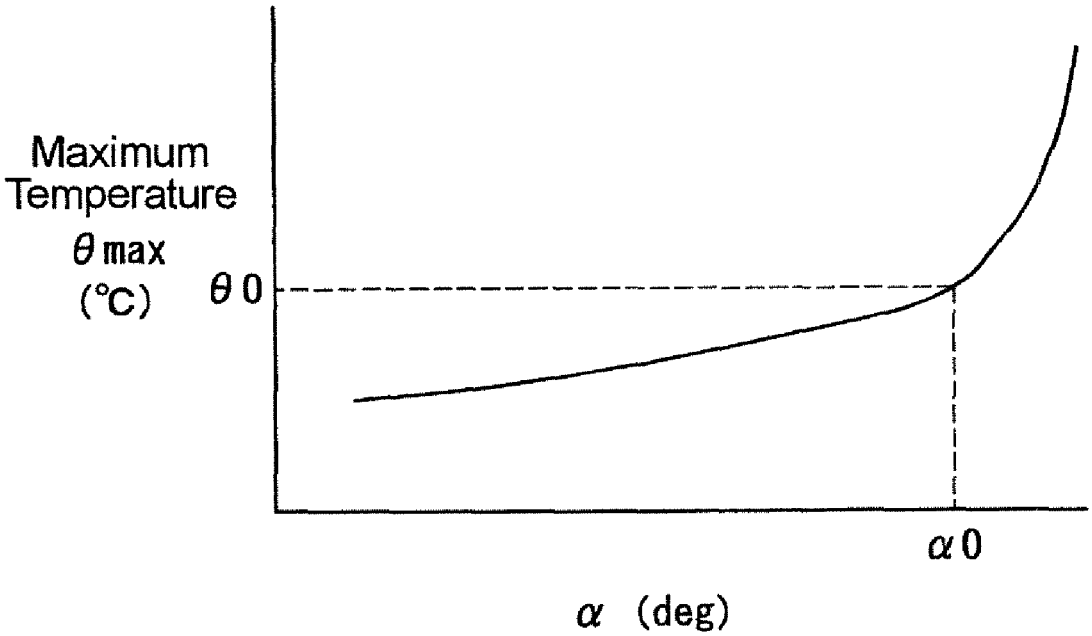
Figure 9:
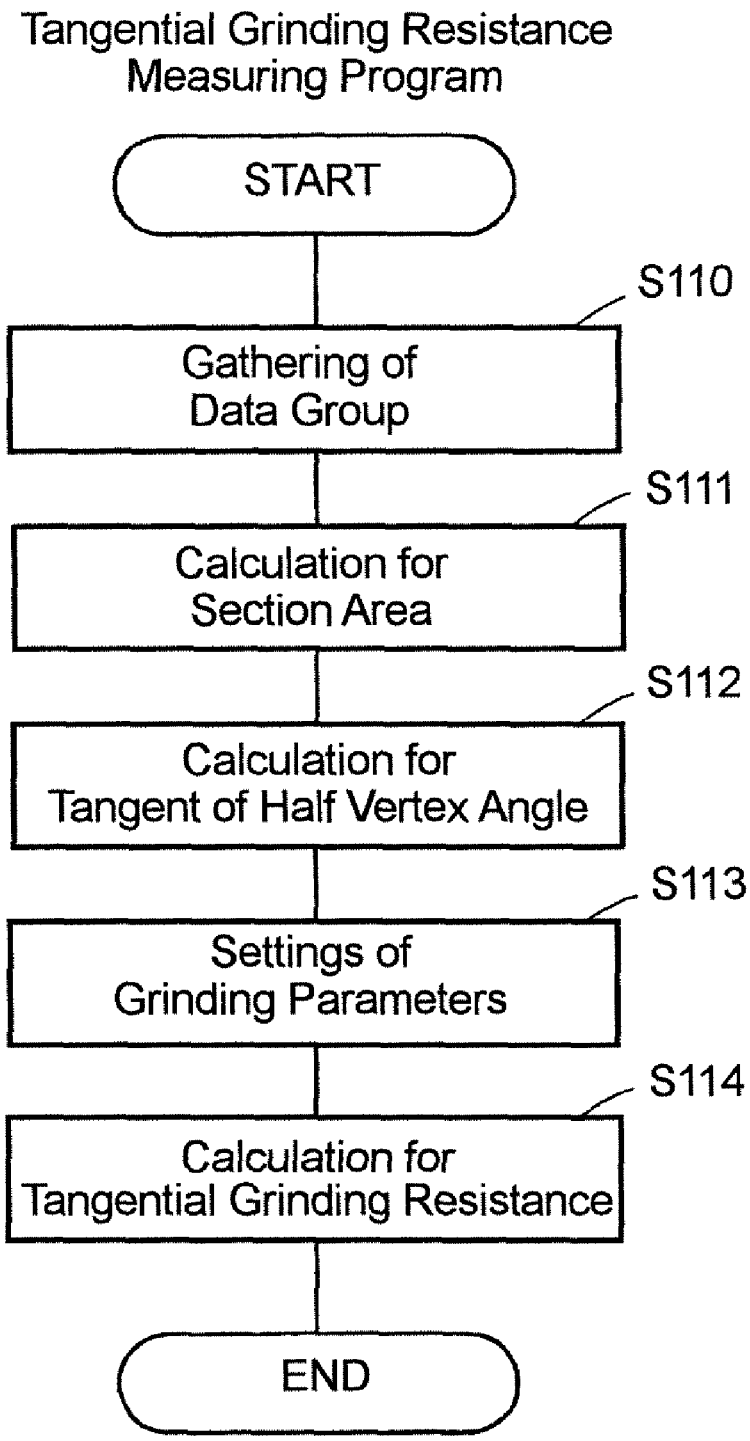
Figure 10:
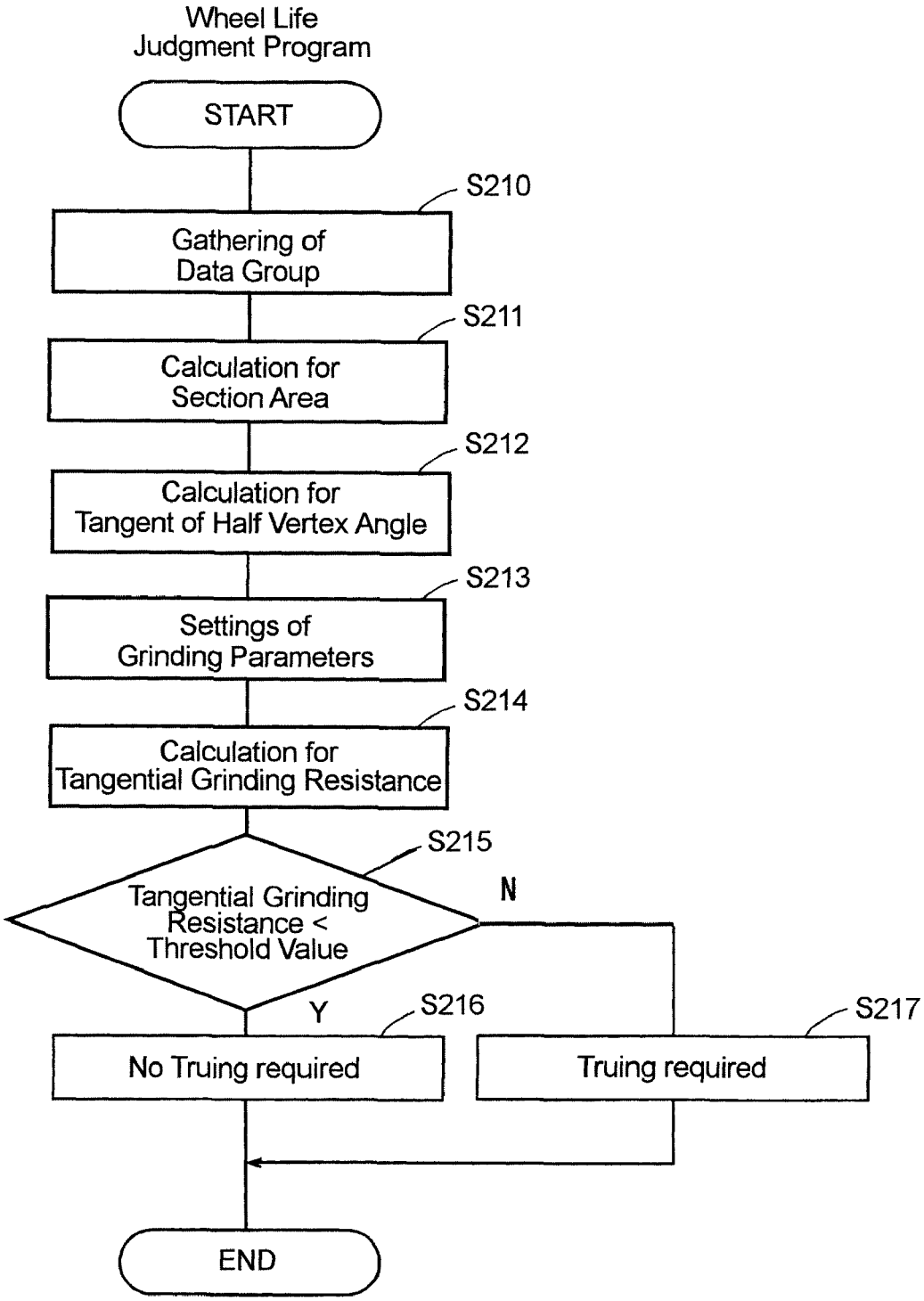
Figure 11:
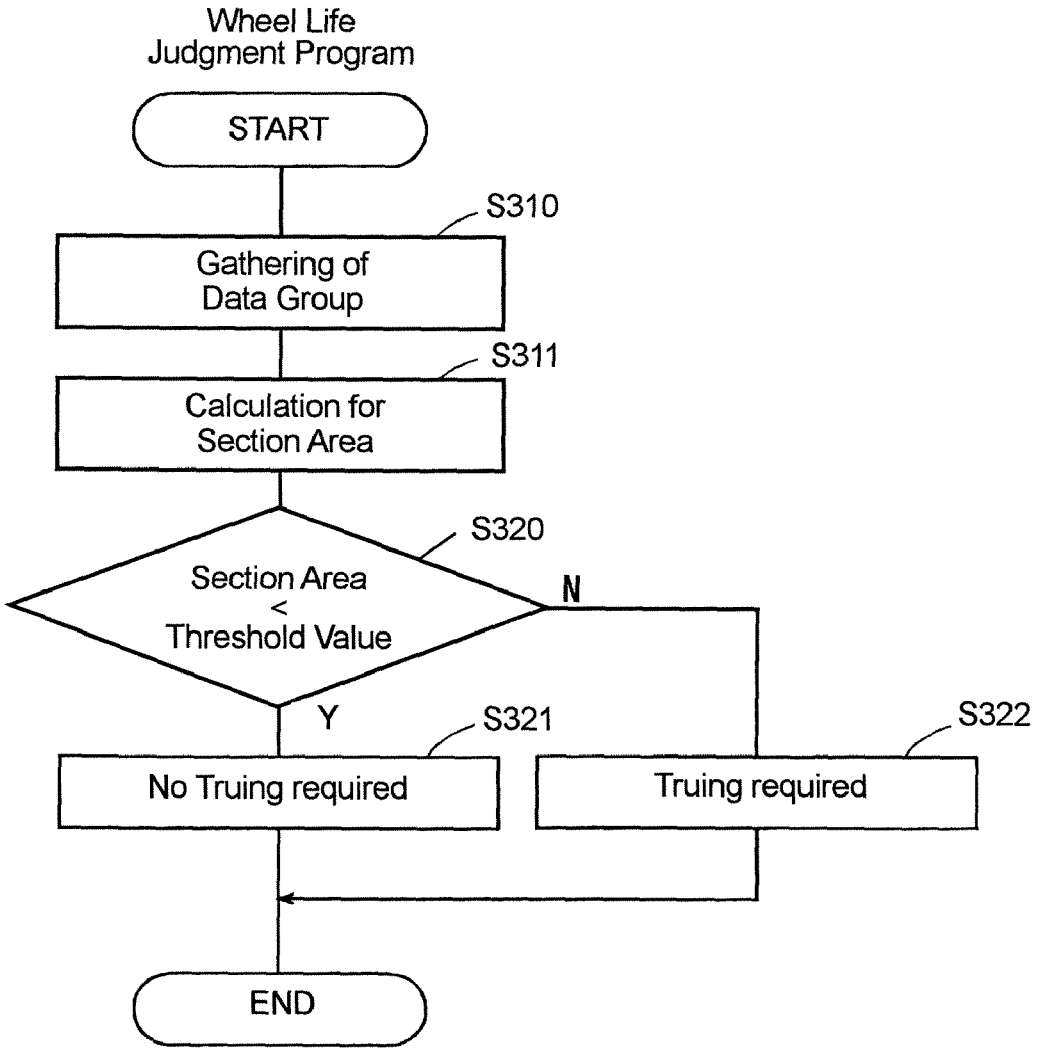
Figure 12:
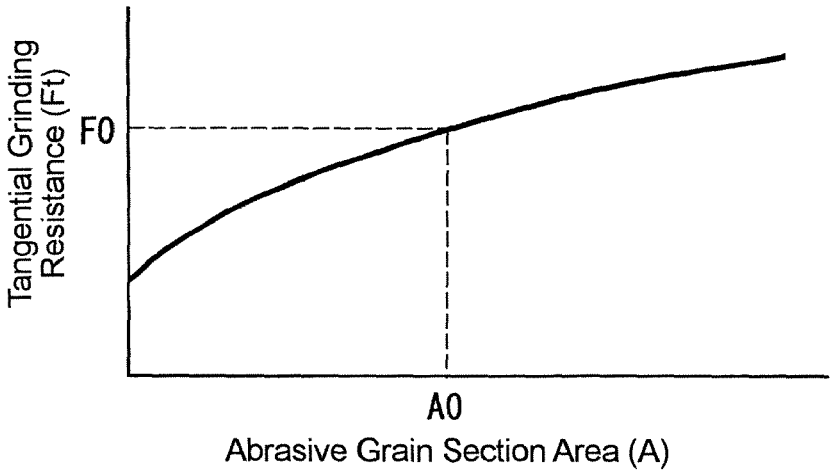

FIG. 8 a graph showing the relation between tangent of the half vertex angle of the abrasive grain cutting edge and maximum temperature;

FIG. 9 is a flow chart showing a tangential grinding resistance measuring program in a second embodiment according to the present invention;

FIG. 10 is a flow chart showing a wheel life judgment program in a third embodiment according to the present invention;

FIG. 11 is a flow chart showing a wheel life judgment program in a fourth embodiment according to the present invention; and FIG. 12 is a graph showing the relation between abrasive grain section area and tangential grinding resistance in the fourth embodiment according to the present invention.

DETAILED DESCRIPTION OF THE PREFERRED EMBODIMENTS

First Embodiment

Hereafter, a grinding condition decision method and apparatus in a first embodiment according to the present invention will be described with reference to FIGS. 1 to 8.

Figure 1:
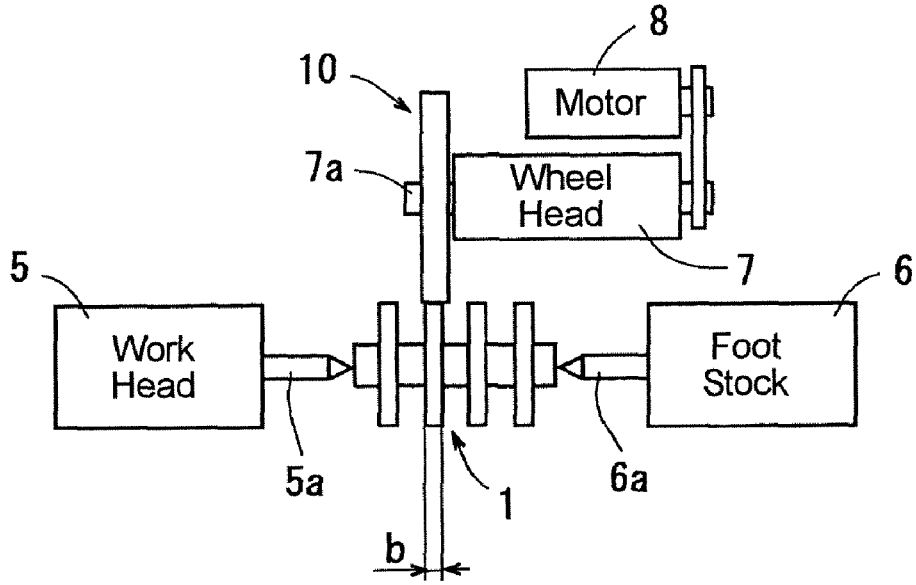
FIG. 1 is a schematic plan view of a grinding machine used in implementing methods and apparatus according to a first embodiment of the present invention.

FIG. 1 schematically shows a grinding machine employed in implementing the grinding condition decision method. In this grinding machine, a workpiece 1 is supported by being pressured at its opposite ends with a work spindle 5*a* of a work head 5 and a foot stock shaft 6*a* of a foot stock 6. A grinding wheel 10 is fixed on a wheel spindle 7*a* rotatably carried by a wheel head 7, and the wheel spindle 7*a* and the grinding wheel 10 are bodily rotated by a motor 8 at a high speed. With advance movement of the wheel head 7, the grinding wheel 10 is brought into contact with the workpiece 1 to grind the same. Here, a symbol "b" represents a grinding width.

Figure 2:
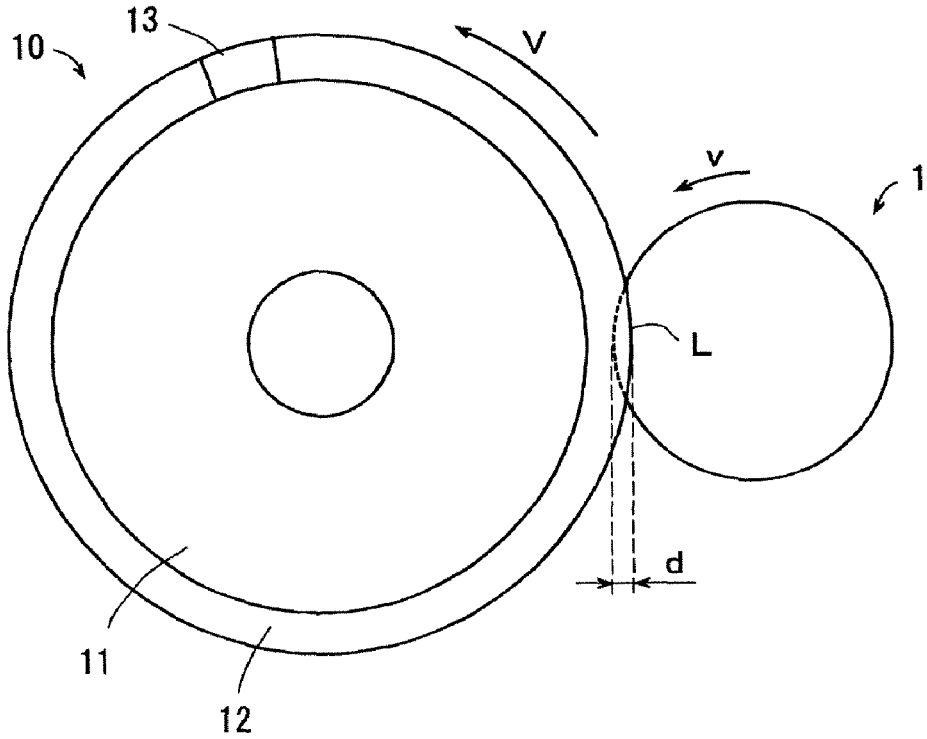
FIG. 2 is a representation showing the relation between a grinding wheel and a workpiece in a grinding state.

FIG. 2 shows the relation between the grinding wheel 10 and the workpiece 1 in a grinding state. The grinding wheel 10 is of the construction that a grinding wheel layer 12 in which superabrasive grains such as CBN (Cubic Boron Nitride) or diamond are bonded with a bond material is formed on an outer circumferential surface of a disc-like core member 11. The grinding wheel layer 12 is composed of a plurality of grinding wheel segments or chips 13 which are arranged on the outer circumferential surface of the disc-like core member 11. Here, symbols V, v, d and L represent the wheel circumferential speed, the workpiece rotational speed, the infeed depth per revolution of the workpiece 1, and the contact length between the grinding wheel 10 and the workpiece 1, respectively.

Figure 3:
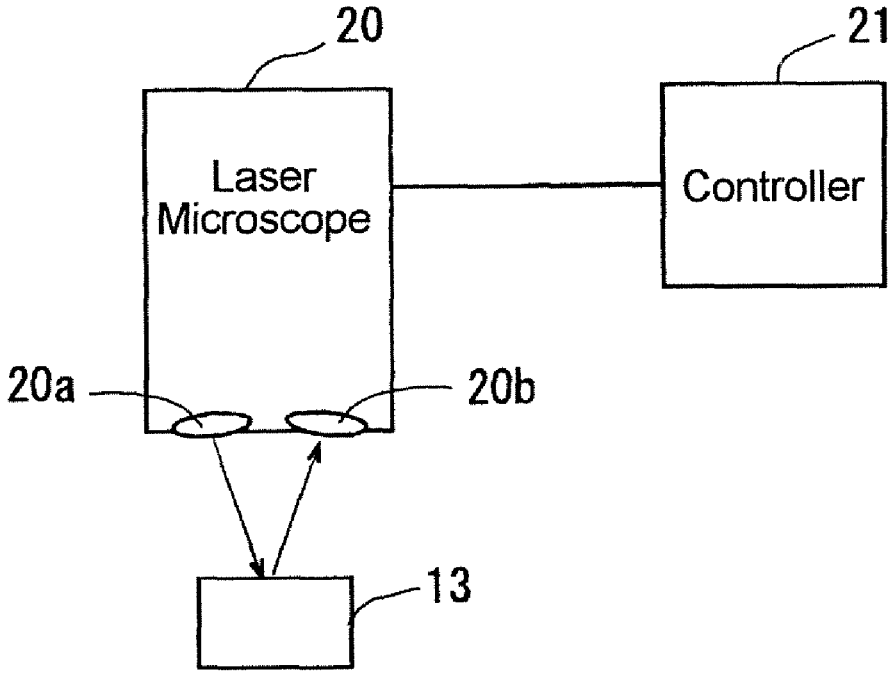
FIG. 3 is a schematic view showing a grinding condition decision apparatus for implementing a grinding condition decision method according to a first embodiment of the present invention.

FIG. 3 schematically shows a grinding condition decision apparatus used in implementing a grinding condition decision method in the first embodiment. The grinding condition decision apparatus is provided with a laser microscope 20 and a controller 21. The laser microscope 20 is provided with a laser floodlight 20*a* for irradiating a laser beam on the grinding wheel chip 13 and a CCD (charge coupled device) camera 20*b* for detecting the laser beam reflecting from the grinding wheel chip 13. The laser microscope 20 and the controller 21 are connected electrically. The laser microscope 20 may be, for example, a color laser 3D profile microscope, model VK-9500 GII, available from KEYENCE CORPORATION, Osaka, Japan. The laser microscope 20 is capable of measuring a three-dimensional shape of a predetermined area on a grinding wheel chip 13 positioned before the CCD camera 20*b*. The three-dimensional shape can be defined by data indicative of X-Y coordinates and depths or heights at respective positions in the X-Y plane and hence, includes three-dimensional shapes defining the surfaces of a plurality of abrasive grains which are distributed within the predetermined area on the grinding wheel chip 13. In the present embodiment, a particular one of the grinding wheel chips which is indicated by the reference numeral 13 in FIG. 2 is selected as an object to be measured by the laser microscope 20.

Next, the grinding condition decision method will be described with reference to a flow chart for a grinding condition decision program shown in FIG. 4. The grinding condition decision apparatus is placed at a predetermined position such as, for example, a position on the rear side of the wheel head 10 or the like. The laser microscope 20 of the model VK-9500 GII is composed primarily of a stage section for mounting an object to be measured and a measuring section including the laser floodlight 20*a* and the CCD camera 20*b*. For placement on the rear side of the wheel head 10, the stage section is removed from the laser microscope 20, and the measuring section of the laser microscope 20 is mounted on the wheel head 7 to face with the grinding surface of the grinding wheel 10. In this embodiment, the grinding wheel 10 is rotationally indexed and positioned to present the particular grinding wheel chip 13 before the laser microscope 20 mounted on the wheel head 7. Therefore, it becomes possible for the laser microscope 20 to measure the three-dimensional shape of a predetermined area on the particular grinding wheel chip 13. Of course, any other laser microscope than that of Model VK-9500 GII may be employed for this purpose. With the depression of a start switch (not show), the grinding condition decision program shown in FIG. 4 begins to be executed by the controller 21.

Figure 4:
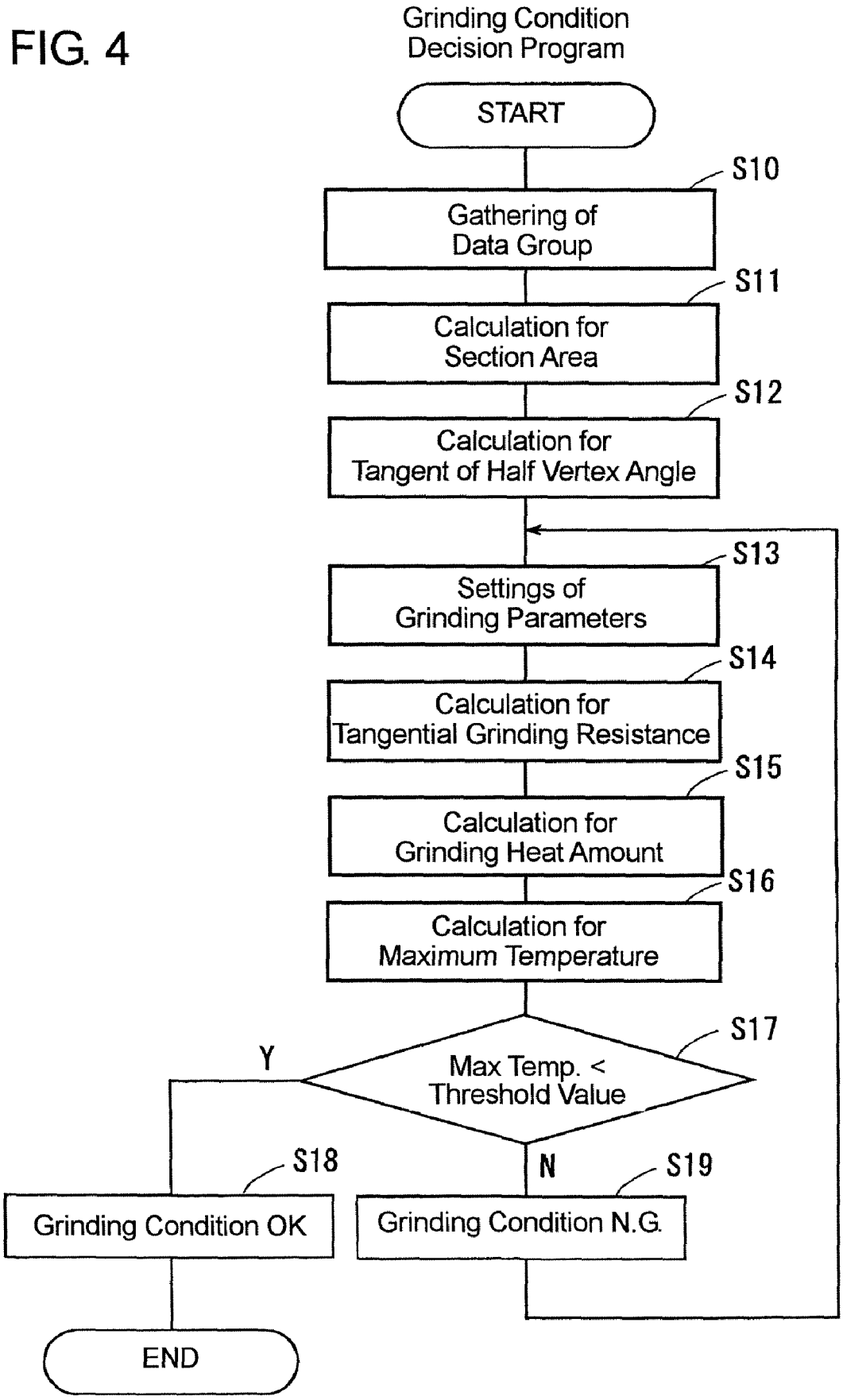
FIG. 4 is a flow chart showing a grinding condition decision program used to implement the grinding condition decision method according to a first embodiment of the present invention.

Upon execution starting of the grinding condition decision program shown in FIG. 4, there are gathered at step S10 a data group which represents the three-dimensional shape of the predetermined area on the particular grinding wheel chip 13. More specifically, a laser beam from the laser floodlight 20*a* is irradiated on the particular grinding wheel chip 13 which is oriented before the laser microscope 20, in response to a command from the controller 21. The laser beam reflecting from the particular grinding wheel chip 13 is detected by the CCD camera 20*b*, and the detection data is transmitted to the controller 21. Where the grinding surface of the predetermined area on the particular grinding wheel chip 13 is taken as a reference X-Y plane, the data includes coordinates in the reference X-Y plane and depths or heights (i.e., distances in a Z-direction normal to the X-Y place) at respective positions in the reference X-Y plane. Thus, the three-dimensional shape of the predetermined area on the particular grinding wheel chip 13 including a plurality of abrasive grains can be obtained. In this manner, the data transmitted from the CCD camera 20*b* to the controller 21 is gathered as a data group which represents the three-dimensional shape of the predetermined area on the particular grinding wheel chip 13 including the surface shapes of the plurality of abrasive grains, and the data group is stored in a suitable memory (not shown) of the controller 21. In greater details, data groups are gathered to acquire one for several numbers (e.g., 4 meshes) of the meshes which are formed by partitioning the predetermined area at predetermined intervals in X and Y-axis directions and are consolidated to be stored as matrix data. In FIG. 5, the matrix has lines b1-b10 and columns a1-a10. Here, step S10 constitutes a step and means for gathering the data group.

At step S11, an average abrasive grain section area (A) at an infeed depth (g) of abrasive gain cutting edges from the highest top surface of the abrasive grains which are distributed within the predetermined area is calculated based on the data group. More specifically, height dimensions in the Z-direction of the matrix data are filtered or cut away at the level of the infeed depth (g) for section areas (A) at the predetermined depth (g) of the plurality of abrasive grains within the predetermined area shown in FIG. 5, whereby a plurality of lands at the same level as the infeed depth (g) are taken out. The section areas (A) which are the areas of such lands can be obtained by counting the number of pixels forming each of such lands or by performing any other suitable image processing. Each of the section areas (A) so obtained may take the form of either one of circle, elliptical, triangle, elongate or the like. In this particular embodiment, the section areas (A) are obtained with sixty abrasive grains which are distributed within the predetermined area on the particular grinding wheel chip 13. Although the number of abrasive grains with which the section areas (A) are calculated is arbitrarily chosen, it may preferably be in a range of fifty through sixty. Then, the sections areas (A) are averaged for a representative section area (A) which is representative of the section areas (A) of the abrasive grains within the predetermined area. In this way, it can be done to precisely measure the representative or average abrasive grain section area (A) at the infeed depth (g) of the abrasive grain cutting edges within the predetermined area shown in FIG. 5.

The infeed depth (g) is less than 10 μm (micrometer) and is usually in a range of 3-5 μm or so. Although the distance which is measured from the highest top surface for the abrasive grain section area (A) is arbitrarily chosen, it is preferable that the distance is chosen to be the infeed depth (g) of the abrasive grain cutting edges, because where the choice is so made, a calculation value and an actually measured value of the abrasive grain section area (A) well coincide with each other. Step S11 constitutes a section area calculation step and means. Further, steps S10 and S11 constitute a section area obtaining step and means. Although the calculation for the average section area (A) is made in this particular embodiment for the purpose of ease in the calculation processing at steps S12-S16 as referred to later, it is possible, if need be, to use in these following steps the respective abrasive grain section areas (A) of the abrasive grains within the predetermined area as they are. In this modified case, the processing at each of the following steps S12-S16 may be carried out with respect to each of the abrasive grains within the predetermined area, so that the routine may become somewhat complicated, but may provide more accurate processing results.

At step S12, the cutting edge of each abrasive grain is assumed as a conical model 30, and a tangent (tan α) of a half vertex angle (α) is calculated. That is, as shown in FIG. 6, a hypothesis or assumption is made of the conical model 30 which takes the average abrasive grain section area (A) as its bottom area of a radius (r) and the infeed depth (g) as its height, and a tangent (tan α) of a half vertex angle (α) which is half of the vertex angle of the conical model 30 is obtained by the calculation using the following expression 1. In FIG. 6, a component (Ft) represents a tangential grinding resistance which is a force needed to grind the workpiece 1. Also, a component Fn represents a normal grinding resistance which is a force needed to plunge the abrasive grain into the workpiece 1. Step S12 constitutes a tangent calculation step and means.

$$\tan\alpha = 1/g\cdot\sqrt{(A/\pi)} \quad \text{[Expression 1]}$$

At step S13, grinding parameters are set. The grinding parameters include at least one of specific grinding energy (Cp), wheel circumferential speed (V), infeed amount (d) per workpiece revolution, grinding width (b), workpiece rotational speed (v), friction coefficient (μ) between abrasive grains and workpiece, contact length (L) between grinding wheel and workpiece, workpiece density (ρ), specific heat (c) of workpiece, thermal conductivity (k) of workpiece, and thermal distribution coefficient (a) to workpiece. Of the grinding parameters, those determined automatically in dependence on the workpiece 1 suffice to be set once in the beginning. Step S13 constitutes a parameter setting step and means.

At step S14, the tangential grinding resistance (Ft) is calculated. Where the grinding parameters are set as mentioned earlier, the normal grinding resistance (Fn) is calculated from the grinding parameters and the tangent (tan α) of the half vertex angle (α) by the calculation using the following expression 2. Further, an expression for the tangential grinding resistance (Ft) is formulated as the following expression 3. Thus, the tangential grinding resistance (Ft) is calculated by the following expression 4 which can be derived from the expressions 2 and 3. This enables the tangential grinding resistance (Ft) to be obtained for an average abrasive grain which is representative of sixty abrasive grains distributed within the predetermined area shown in FIG. 5. Step S14 constitutes a tangential grinding resistance calculation step and means.

$$Fn = Cp(\pi vdb/2V)\tan\alpha \quad \text{[Expression 2]}$$

$$Ft = Cp(vdb/V) + \mu Fn \quad \text{[Expression 3]}$$

$$Ft = Cp(vdb/V) + \mu Cp(\pi vdb/2V)\tan\alpha \quad \text{[Expression 4]}$$

At step S15, a grinding heat amount (Q) is calculated. The grinding heat amount (Q) is calculated by the following expression 5. Step S15 constitutes a grinding heat amount calculation step and means.

$$Q = (FtV)/(Lb) \quad \text{[Expression 5]}$$

At step S16, the maximum temperature (θmax) is calculated. The maximum temperature (θmax) is calculated by the following expression 6. In this particular embodiment, the following expression 7 which takes a constant K1 as 1.1128 and another constant K2 as 0.5 is employed for the calculation. Step S16 constitutes a maximum temperature calculation step and means.

$$\theta\max = K1\{L/(\rho ckv)\}^{K2} \times aQ \quad \text{[Expression 6]}$$

$$\theta\max = 1.128\{L/(\rho ckv)\}^{0.5} \times aQ \quad \text{[Expression 7]}$$

In the grinding condition decision method, it is easy to calculate the maximum temperature (θmax), because the tangential grinding resistance (Ft), the grinding heat amount (Q) and the maximum temperature (θmax) can be calculated from the specific grinding energy (Cp), the wheel circumferential speed (V), the infeed amount (d) per workpiece revolution, the grinding width (b), the workpiece rotational speed (v), the friction coefficient (μ) between abrasive grains and workpiece, the contact length (L) between grinding wheel and workpiece, the workpiece density (ρ), the specific heat (c) of workpiece, the thermal conductivity (k) of workpiece, the thermal distribution coefficient (a) to workpiece, the half vertex angle (α) of the conical model, and the constants K1 and K2.

FIG. 7 shows the relation between the tangent (tan α) of the half vertex angle (α) and the normal grinding resistance (Fn). Reference numeral G1 designates a graph of calculated values, while reference numeral G2 designates a graph of actually measured values. FIG. 7 demonstrates that a correlation holds between the calculated values and the actually measured values.

At step S17, the maximum temperature (θmax) is compared with a threshold value. The maximum temperature (θmax) is an average or representative of those of the sixty abrasive grains. When the maximum temperature (θmax) is less than the threshold value (YES), it is judged that grinding burn does not occur, and the routine proceeds to step S18. When the maximum temperature (θmax) is equal to or greater than the threshold value (NO), on the other hand, it is judged that grinding burn occurs, and the routine proceeds to step S19. Here, FIG. 8 shows the relation between the half vertex angle (α) and the maximum temperature (θmax). As shown in FIG. 8, where the grinding burn should occur with the maximum temperature (θmax) being equal to θ0 or higher (namely, θ0 should be taken as the threshold value), it is represented that the grinding burn should occur with the half vertex angle (α) being equal to α0 or greater.

At step S18, a statement that the grinding condition having been set should not cause grinding burn to occur is displayed on a monitor (not shown) of the controller 21, and the execution of the program is terminated. At step S19, on the contrary, another statement that the grinding condition having been set should cause grinding burn to occur is displayed on the monitor of the controller 21, and the routine is returned to step S13, at which new or modified grinding parameters are set again. Therefore, the settings of the grinding parameters are corrected until the maximum temperature (θmax) becomes less than θ0. The grinding parameters to be corrected are other than those which can be determined automatically in dependence on the workpiece 1 and may primarily be the workpiece rotational speed (v) and the infeed amount (d). Steps S17-S19 constitute a grinding burn judgment step and means. The grinding condition decision program is executed before the starting of the grinding operations and at a predetermined time between truing intervals or each time the grindings of a predetermined number of workpieces are completed.

In the grinding condition decision method in the first embodiment, since a grinding condition is decided so that the maximum temperature (θmax) obtained through the predetermined steps becomes equal to or less than the threshold value, it can be done to decide the grinding condition without relying on any of try and error and worker's experiences. Also in the grinding condition decision method, an assumption is made of the conical model 30 taking as its bottom area the average abrasive grain section area (A) which is at the infeed depth (g) of the abrasive grain cutting edges from the highest top surface of the abrasive grains, and also taking the infeed depth (g) as its height, in which assumption, the normal grinding resistance (Fn) which is calculated from the tangent (tan α) of the half vertex angle (α) and the grinding parameters well coincides with an actually measured value thereof. Therefore, the tangential grinding resistance (Ft), the grinding heat amount (Q) and the maximum temperature (θmax) which can be all derived from the normal grinding resistance (Fn) seem to well coincide with actually measured values of those. Accordingly, in the grinding condition decision method in the present embodiment, it is possible to decide a hard-to-vary grinding condition within a short period of time and also to suppress the occurrence of the grinding burn.

In the foregoing first embodiment, the three-dimensional shape within the predetermined area on the grinding wheel chip 13 is measured by the laser microscope 20 which is mounted on the rear side of the wheel head 7. In a modified form, however, the laser microscope 20 in a complete construction with the measuring section and the stage section being assembled may be used outside the grinding machine, and the particular grinding wheel chip 13 may be removably attached to the grinding wheel 10. Thus, the particular grinding wheel chip 13 may be temporarily removed from the grinding wheel 10, may be placed on the laser microscope 20 outside the grinding machine for measurement, and may again be attached to the grinding wheel 10 after the measurement.

Next, with reference to the accompanying drawings, description will be made regarding a tangential grinding resistance measuring method for a grinding wheel in a second embodiment according to the present invention and a wheel life judgment method and apparatus utilizing the measuring method in each of third and fourth embodiments according to the present invention. In each of the second to fourth embodiments, there is used a grinding machine taking the same configuration as that which has been described in the foregoing first embodiment with reference to FIGS. 1 and 2. Therefore, the foregoing descriptions regarding the construction of the grinding machine are incorporated in each of the second to fourth embodiments, and FIGS. 1 and 2 as used in the forgoing first embodiment will be used in each of the second to fourth embodiments.

The grinding condition decision apparatus shown in FIG. 3 is also used as an apparatus for implementing a tangential grinding resistance measuring method in the second embodiment or as a wheel life judgment apparatus for implementing a wheel life judgment method in each of the third and fourth embodiments. In the second to fourth embodiments, the laser microscope 20 and the controller 21 shown in FIG. 3 constitute section area obtaining means, and the controller 21 alone constitutes tangent calculation means, parameter setting means, tangential grinding resistance calculation means and wheel life judgment means.

Second Embodiment

Next, a tangential grinding resistance measuring method for a grinding wheel in the second embodiment will be described with reference to a flow chart for a tangential grinding resistance measuring program shown in FIG. 9. The tangential grinding resistance measuring method in the second embodiment is constructed as a part or subcombination of the grinding condition decision method having been described earlier in the foregoing first embodiment. That is, the program flow chart shown in FIG. 9 takes the same construction as a part of the program flow chart shown in FIG. 4 used in the foregoing first embodiment, and steps S110-S114 in FIG. 9 respectively correspond to the foregoing steps S10-S14 in FIG. 4. That is, the same processing as those at steps S10-S14 in FIG. 4 are executed at steps S110-S114 in FIG. 9, respectively, and therefore, descriptions regarding the details at each of theses steps S110-S114 are omitted to avoid repetition and are replaced by those in the foregoing first embodiment. However, as the difference from the foregoing first embodiment, the parameter setting step S113 is performed to set at least one of specific grinding energy (Cp), wheel circumferential speed (V), infeed amount (d) per workpiece revolution, grinding width (b), workpiece rotational speed (v), and friction coefficient (μ) between abrasive grains and workpiece.

The tangential grinding resistance measuring method in the second embodiment performs substantially the same manner as described at steps S10-S14 in the foregoing first embodiment and achieves substantially the same effects as described at steps S10-S14 in the foregoing first embodiment. More specifically, in the tangential grinding resistance measuring method, it is easy to calculate the tangential grinding resistance (Ft), because the same can be calculated from the specific grinding energy (Cp), the wheel circumferential speed (V), the infeed amount (d) per workpiece revolution, the grinding width (b), the workpiece rotational speed (v), the friction coefficient (μ) between abrasive grains and the workpiece 1, and the half vertex angle (α) of the conical model. Further, the relation represented in FIG. 7 holds between the tangent (tan α) of the half vertex angle (α) and the normal grinding resistance (Fn). Thus, with respect to the normal grinding resistance, the correlation is demonstrated to exist between the calculated values and the actually measured values. Therefore, it seems that the tangential grinding resistance (Ft) which is calculated from the normal grinding resistance (Fn) based on the conical model 30 well coincides with an actual measured value thereof. Accordingly, the tangential grinding resistance measuring method for a grinding wheel in the second embodiment is useful in judging the wheel life precisely.

Third Embodiment

Next, a wheel life judgment method in the third embodiment will be described with reference to a flow chart for a wheel life judgment program shown in FIG. 10. The wheel life judgment program is for judging the wheel life by the use of the aforementioned tangential grinding resistance measuring method. The term "wheel life" herein means the service life of the grinding wheel 10 from a certain truing to the next and hence, means the service life during which the grinding wheel 10 given a certain truing can work until the next truing should be done thereon. Thus, the term "wheel life" herein may be defined as "truing-to-truing service life" when expressed in other words. A wheel life judgment apparatus for implementing the wheel life judgment method takes the same construction as that shown in FIG. 3 and is placed at a predetermined position such as, for example, a position on the rear side of the wheel head 10 or the like in the same manner as the laser microscope 20 in the foregoing first embodiment. With the depression of a start switch (not show), the wheel life judgment program shown in FIG. 10 begins to be executed by the controller 21.

When the wheel life judgment program shown in FIG. 10 begins, steps S210-S214 are executed. The details of these steps are the same as those of steps S110-S114 shown in FIG. 9 (i.e., those of steps S10-S14 shown in FIG. 4) which have already been described in the tangential grinding resistance measuring method (i.e., in the grinding condition decision method) for a grinding wheel, and the description of such details will be omitted to avoid repetition.

At step S215, the tangential grinding resistance (Ft) is compared with a threshold value. The tangential grinding resistance (Ft) is an average between those of sixty abrasive grains distributed within the predetermined area (FIG. 5) on the particular grinding wheel chip 13. When the tangential grinding resistance (Ft) is less than the threshold value (YES), it is judged that the wheel life has not been reached yet, and the routine proceeds to step S216. When the tangential grinding resistance (Ft) is equal to or greater than the threshold value (NO), on the other hand, it is judged that the wheel life has already been reached, and the routine proceeds to step S217. At step S216, a statement that a truing is not to be done is displayed on the monitor of the controller 21, and the execution of the program is terminated. At step S217, on the contrary, another statement that a truing is to be done is displayed on the monitor of the controller 21, and the execution of the program is terminated. Steps S215-S217 constitute a wheel life judgment step and means.

In the wheel life judgment method in the third embodiment, because the wheel life is judged at steps S215-S217 based on the tangential grinding resistance (Ft), it can be done to judge the wheel life precisely. The wheel life judgment method is implemented at a predetermined time between truing intervals or each time the grindings of a predetermined number of workpieces are completed.

Fourth Embodiment

Next, another wheel life judgment method in the fourth embodiment will be described with reference to a flow chart for another wheel life judgment program shown in FIG. 11. This wheel life judgment program is for judging the wheel life by the use of the first several steps of the aforementioned tangential grinding resistance measuring method and is capable of judging the wheel life simply and easily. A wheel life judgment apparatus for implementing the wheel life judgment method takes the same construction as that shown in FIG. 3 and is placed at a predetermined position such as, for example, a position on the rear side of the wheel head 10 or the like in the same manner as the laser microscope 20 in the foregoing first embodiment. With the depression of a start switch (not show), the wheel life judgment program shown in FIG. 10 begins to be executed by the controller 21.

When the wheel life judgment program shown in FIG. 11 begins, steps S310 and S311 are executed. The details of these steps are the same as those of steps S110 and S111 shown in FIG. 9 (i.e., those of steps S10 and S11 shown in FIG. 4) which have already been described in the tangential grinding resistance measuring method (i.e., in the grinding condition decision method) for a grinding wheel, and the descriptions of such details will be omitted to avoid repetition.

At step S320, the average abrasive grain section area (A) obtained at step S311 is compared with another threshold value. The average abrasive grain section area (A) is an average or representative of those of sixty abrasive grains distributed within the predetermined area (FIG. 5) on the particular grinding wheel chip 13. When the average abrasive grain section area (A) is less than the threshold value (YES), it is judged that the wheel life has not been reached yet, and the routine proceeds to step S321. When the abrasive grain section area (A) is equal to or larger than the threshold value (NO), on the other hand, it is judged that the wheel life has already been reached, and the routine proceeds to step S322. At step S321, a statement that a truing is not to be done is displayed on the monitor of the controller 21, and the execution of the program is terminated. At step S322, on the contrary, another statement that a truing is to be done is displayed on the monitor of the controller 21, and the execution of the program is terminated. Steps S320-S322 constitute a wheel life judgment step and means.

Here, description will be made regarding the reasons why the wheel life can be judged by comparing the average abrasive grain section area (A) with the threshold value in the manner as aforementioned. Where a material of the workpiece 1 is decided and where the infeed amount (d) per workpiece revolution, the specific grinding energy (Cp), the wheel circumferential speed (V), the workpiece rotational speed (v), the grinding width (b) and the friction coefficient (μ) between abrasive grains and workpiece 1 are fixed to conventional values, the tangential grinding resistance (Ft) can be obtained by the following expression 8. In the expression, symbols K1 and K2 are constants.

$$Ft=K1+K2\sqrt{A} \qquad \text{[Expression 8]}$$

From the expression 8, it can be understood that in the conical model 30 shown in FIG. 6, the tangential grinding resistance (Ft) is in a proportional relation with the half square of the abrasive grain section area (A). FIG. 12 shows a relation between the tangential grinding resistance (Ft) and the abrasive grain section area (A). Where in FIG. 12, the wheel life should have been reached with the tangential grinding resistance (Ft) being equal to F0 or greater, it can be judged that wheel life has been reached with the abrasive grain section area (A) being equal to A0 or greater. That is, the value A0 can be taken as the threshold value. Accordingly, it is understood that the wheel life can be judged precisely by comparing the abrasive grain section area (A) with the threshold value. The wheel life judgment method is implemented at a predetermined time between truing intervals or each time the grindings of a predetermined number of workpieces 1 are completed.

Although in the foregoing first to fourth embodiments, the abrasive grain section areas (A) are obtained by measuring the three-dimensional shape of the predetermined area on the particular grinding wheel chip 13, it may be obtained by measuring the three-dimensional shape of the predetermined area on another grinding wheel chip other than the particular grinding wheel chip 13 or by measuring the three-dimensional shape within a predetermined area on the workpiece 1 after a very first grinding of the workpiece 1 with the grinding wheel 10. Alternatively, where gold is vapor-deposited on the surfaces of the abrasive grains, the abrasive grain section areas (A) may be obtained by measuring areas from which gold has been peeled off by grinding. Further alternatively, the abrasive grain section areas (A) may be obtained by mechanically measuring the three-dimensional shape within the predetermined area by the use of a measuring probe.

In the first to fourth embodiments, the calculation for the average section area (A) at step S11, S111, S211 or S311 is made for the purpose of ease in the calculation processing at those steps subsequent thereto, as mentioned earlier in connection with the first embodiment. If need be, however, it is possible to use in those steps subsequent thereto the respective abrasive grain section areas (A) of the abrasive grains within the predetermined area as they are. In this modified case, the processing at each of those steps (e.g., steps S12-S17, S112-S114, S212-S215 or S320) subsequent thereto may be carried out with respect to each of the abrasive grains within the predetermined area, so that the routine shown in FIG. 4, 9, 10 or 11 may become somewhat complicated, but may provide more accurate processing results.

Various features and many of the attendant advantages in the foregoing embodiments will be summarized as follows:

In the grinding condition decision method and apparatus in the foregoing first embodiment typically shown in FIG. 4, since the grinding condition is determined so that the maximum temperature (θmax) obtained through the aforementioned predetermined steps becomes equal to or less than the threshold value, it can be realized to decide the grinding condition without relying on any of try and error and worker's experiences. Further, in the grinding condition decision method and apparatus, an assumption is made of the conical model 30 for a cutting edge of each abrasive grain which model 30 takes the abrasive grain section area (A) as its bottom surface and the predetermined depth (g) as its height, and the tangential grinding resistance (Ft) which is calculated from the tangent (tan α) of the half vertex angle (α) and the grinding parameters well coincides with an actually measured value therefor. For this reason, it seems that the tangential grinding resistance (Ft), the grinding heat amount (Q) and the maximum temperature (θmax) which can be calculated from a normal grinding resistance (Fn) based on the conical model 30 also well coincide with actually measured values therefor. Therefore, in the grinding condition decision method and apparatus, it is possible to decide a hard-to-vary grinding condition within a short period of time and to suppress the occurrence of grinding burns.

Also in the grinding condition decision method and apparatus in the foregoing first embodiment typically shown in FIGS. 3 and 4, the data group representing the three-dimensional shape of the predetermined area on a grinding wheel chip 13 is obtained by the laser microscope 20 at the data group gathering step and means S10, and the abrasive grain section area (A) is calculated based on the data group at the section area calculation step and means S11. Thus, it can be done to measure the abrasive grain section area (A) which is at the predetermined depth (g) from the highest top surface of the abrasive grains within the predetermined area on the grinding wheel chip 13.

Also in the grinding condition decision method and apparatus in the foregoing first embodiment typically shown in FIGS. 4 and 6, the tangential grinding resistance (Ft), the grinding heat amount (Q) and the maximum temperature (θmax) are calculated from specific grinding energy (Cp), wheel circumferential speed (V), infeed amount (d) per workpiece revolution, grinding width (b), workpiece rotational speed (v), friction coefficient (μ) between abrasive grains and workpiece, contact length (L) between grinding wheel and workpiece, workpiece density (ρ), specific heat (c) of workpiece, thermal conductivity (k) of workpiece, thermal distribution coefficient (a) to workpiece, and the half vertex angle (α) of the conical model 30. Thus, it is possible to calculate the maximum temperature (θmax) easily.

Also in the grinding condition decision method and apparatus in the foregoing first embodiment typically shown in FIGS. 4 and 6, since the predetermined depth is the infeed depth (g) of the cutting edges of the abrasive grains distributed within the predetermined area on the grinding wheel chip 13, the conical model 30 becomes adequate, so that it is possible to precisely calculate the tangential grinding resistance (Ft), the grinding heat amount (Q) and the maximum temperature (θmax).

In the tangential grinding resistance measuring method in the foregoing second embodiment typically shown in FIGS. 6 and 9, an assumption is made of the conical model 30 for a cutting edge of each abrasive grain which model 30 takes the abrasive grain section area (A) as its bottom surface and the predetermined depth (g) as its height, and a normal grinding resistance (Fn) which is calculated from the tangent (tan α) of the half vertex angle (α) and the grinding parameters well coincides with an actually measured value therefor. For this reason, it seems that the tangential grinding resistance (Ft) which can be calculated from the normal grinding resistance (Fn) based on the conical model 30 also well coincides with an actually measured value therefor. Therefore, in the tangential grinding resistance measuring method, it is possible to judge the wheel life precisely.

Also in the tangential grinding resistance measuring method in the foregoing second embodiment typically shown in FIGS. 6 and 9, the data group representing the three-dimensional shape of the predetermined area on the grinding wheel chip 13 is obtained by the laser microscope (20) at the data group gathering step S110, and the abrasive grain section area (A) is calculated based on the data group at the section area calculation step (S111). Thus, it can be done to measure the abrasive grain section area (A) which is at the predetermined depth (g) from the highest top surface of the abrasive grains within the predetermined area on the grinding wheel chip 13.

Also in the tangential grinding resistance measuring method in the foregoing second embodiment typically shown in FIGS. 6 and 9, the tangential grinding resistance (Ft) is calculated from specific grinding energy (Cp), wheel circumferential speed (V), infeed amount (d) per workpiece revolution, grinding width (b), workpiece rotational speed (v), friction coefficient (μ) between abrasive grains and workpiece, and the half vertex angle (α) of the conical model 30. Thus, it is possible to calculate the tangential grinding resistance (Ft) easily.

Also in the tangential grinding resistance measuring method in the foregoing second embodiment typically shown in FIGS. 6 and 9, since the predetermined depth is the infeed depth (g) of the cutting edges of the abrasive grains distributed within the predetermined area on the grinding wheel chip 13, the conical model 30 becomes adequate, so that it is possible to precisely calculate the tangential grinding resistance (Ft).

In the wheel life judgment method and apparatus in the third embodiment typically shown in FIG. 10, the abrasive grain section area (A) which is at the predetermined infeed depth from the highest top surface of the abrasive grains forming the grinding surface of the grinding wheel 10 is obtained by the section area obtaining step and means S211, the tangent (tan α) of the half vertex angle (α) which is the half of the vertex angle of the conical model 30 is calculated by the tangent calculation step and means S212, the grinding parameters are set by the parameter setting step and means S213, and the tangential grinding resistance (Ft) is calculated by the tangential grinding resistance calculation step and means S214 from the grinding parameters and the tangent (tan α). Since the wheel life is then judged by the wheel life judgment step and means S215 based on the tangential grinding resistance (Ft), it can be done to judge the wheel life precisely.

In the wheel life judgment method and apparatus in the fourth embodiment typically shown in FIGS. 11 and 12, the abrasive grain section area (A) which is at the predetermined infeed depth (g) from the highest top surface of the abrasive grains within the predetermined area on the grinding wheel chip 13 is obtained by the section area obtaining step and means S311, and the wheel life is judged by the wheel life judgment step and means S320 by the comparison of the abrasive grain section area (A) with the threshold value. Thus, it can be done to judge the wheel life without calculating a tangential grinding resistance (Ft) of the grinding wheel 10. Where the grinding parameters are fixed in the conical model 30, the half square of the abrasive grain section area (A) is in proportion to the tangential grinding resistance (Ft). Therefore, where the grinding parameters are fixed to conventional values, the wheel life can be judged precisely by the use of the abrasive grain section area (A).

Also in the wheel life judgment method and apparatus in the third and fourth embodiments typically shown respectively in FIGS. 10 and 11, the data group representing the three-dimensional shape within the predetermined area on the grinding wheel chip 13 is obtained by the laser microscope 20 at the data group gathering step and means S210, S310, and the abrasive grain section area (A) is calculated by the section area calculation step and means S211, S311 based on the data group. Thus, it can be done to measure the abrasive grain section area (A) which is at the predetermined depth (g) from the highest top surface of the abrasive grains within the predetermined area on the grinding wheel chip 13.

Also in the wheel life judgment method and apparatus in the third and fourth embodiments typically shown respectively in FIGS. 10 and 11, since the predetermined depth is the infeed depth (g) of the cutting edges of the abrasive grains within the predetermined area on the grinding wheel chip 13, the conical model 30 becomes adequate, so that it is possible to precisely calculate the wheel life.

Obviously, numerous further modifications and variations of the present invention are possible in light of the above teachings. It is therefore to be understood that within the scope of the appended claims, the present invention may be practiced otherwise than as specifically described herein.

What is claimed is:

1. A tangential grinding resistance measuring method for a grinding wheel in which a grinding wheel layer having abrasive grains bonded with a bond material is formed on a grinding surface, the resistance measuring method comprising:

obtaining an abrasive grain section area of the grinding wheel which is at a predetermined depth from the highest top surface of a plurality of abrasive grains within a predetermined area on the grinding surface of the grinding wheel;

assuming a conical model for cutting edges of the abrasive grains within the predetermined area, the conical model taking the abrasive grain section area as its bottom surface and the predetermined depth as its height, and of calculating a tangent of a half vertex angle which is half of a vertex angle of the conical model;

setting grinding parameters; and calculating a tangential grinding resistance from the grinding parameters and the tangent.

2. A grinding condition decision method comprising:

calculating a tangential grinding resistance using the tangential grinding resistance measuring method as claimed in claim 1;

calculating a grinding heat amount from the tangential grinding resistance;

calculating a maximum temperature at a grinding point from the grinding heat amount;

judging the occurrence of grinding burn by the comparison of the maximum temperature with a threshold value; and deciding whether or not a grinding condition which is established based on the grinding parameters set at the parameter setting step is acceptable, based on a judgment made at the grinding burn judgment step.

3. A wheel life judgment method comprising:

calculating a tangential grinding resistance using the tangential grinding resistance measuring method as claimed in claim 1;

judging the wheel life of the grinding wheel by the comparison of the tangential grinding resistance with a threshold value.

4. The tangential grinding resistance measuring method as set forth in claim 1, wherein:

the abrasive grain section area obtained is representative of section areas at the predetermined depth of the plurality of abrasive grains within the predetermined area on the grinding surface of the grinding wheel.

5. The tangential grinding resistance measuring method as set forth in claim 1, wherein obtaining the abrasive grain section area includes:

gathering a data group representing the three-dimensional shape of the predetermined area on the grinding surface of the grinding wheel by the use of a laser microscope; and calculating the abrasive grain section area for the plurality of abrasive grains within the predetermined area based on the data group.

6. The tangential grinding resistance measuring method as set forth in claim 1, wherein:

the grinding parameters comprise at least one of specific grinding energy (Cp), wheel circumferential speed (V), infeed amount (d) per workpiece revolution, grinding width (b), workpiece rotational speed (v), friction coefficient (μ) between abrasive grains and workpiece, contact length (L) between grinding wheel and workpiece, workpiece density (ρ), specific heat (c) of workpiece, thermal conductivity (k) of workpiece, and thermal distribution coefficient (a) to workpiece; and where the half vertex angle of the conical model is represented by symbol α and where constants are represented by symbols K1 and K2, the tangential grinding resistance (Ft), the grinding heat amount (Q) and the maximum temperature (θmax) are calculated by the following expressions 1, 2 and 3, respectively $$Ft=Cp(vdb/V)+\mu Cp(\pi vdb/2V)\tan\alpha \quad \text{(Expression 1)}$$

$$Q=(FtV)/(Lb) \quad \text{(Expression 2)}$$

$$\theta\max=K1\{L/(\rho ckv)\}^{K2}\times aQ. \quad \text{(Expression 3)}$$

7. The tangential grinding resistance measuring method as set forth in claim 1 wherein the predetermined depth is an infeed depth of the abrasive grain cutting edges.

8. A wheel life judgment method for a grinding wheel in which a grinding wheel layer having abrasive grains bonded with a bond material is formed on a grinding surface, the wheel life judgment method comprising:

obtaining an abrasive grain section area of the grinding wheel which is at a predetermined depth from the highest top surface of a plurality of abrasive grains within a predetermined area on the grinding surface of the grinding wheel; and judging the wheel life of the grinding wheel by the comparison of the abrasive grain section area with a threshold value.

9. A tangential grinding resistance measuring apparatus for a grinding wheel in which a grinding wheel layer having abrasive grains bonded with a bond material is formed on a grinding surface, the resistance measuring apparatus comprising:

section area obtaining means for obtaining an abrasive grain section area of the grinding wheel which is at a predetermined depth from the highest top surface of a plurality of abrasive grains within a predetermined area on the grinding surface of the grinding wheel;

tangent calculation means for assuming a conical model for cutting edges of the abrasive grains within the predetermined area, the conical model taking the abrasive grain section area as its bottom surface and the predetermined depth as its height, and for calculating a tangent of a half vertex angle which is half of a vertex angle of the conical model;

parameter setting means for setting grinding parameters; and tangential grinding resistance calculation means for calculating a tangential grinding resistance from the grinding parameters and the tangent.

10. A grinding condition decision apparatus comprising:

the tangential grinding resistance measuring apparatus as claimed in claim 9;

grinding heat amount calculation means for calculating a grinding heat amount from the tangential grinding resistance;

maximum temperature calculation means for calculating a maximum temperature at a grinding point from the grinding heat amount;

grinding burn judgment means for judging the occurrence of grinding burn by the comparison of the maximum temperature with a threshold value; and grinding condition decision means for deciding whether or not a grinding condition which is established based on the grinding parameters set by the parameter setting means is acceptable, based on a judgment made by the grinding burn judgment means.

11. A wheel life judgment apparatus comprising:

the tangential grinding resistance measuring apparatus as claimed in claim 9;

wheel life judgment means for judging the wheel life of the grinding wheel by the comparison of the tangential grinding resistance with a threshold value.

12. The tangential grinding resistance measuring apparatus as set forth in claim 9, wherein:

the abrasive grain section area obtained by the section area obtaining means is representative of section areas at the predetermined depth of the plurality of abrasive grains within the predetermined area on the grinding surface of the grinding wheel.

13. The tangential grinding resistance measuring apparatus as set forth in claim 9, wherein the section area obtaining means includes:

data group gathering means for gathering a data group representing the three-dimensional shape of the predetermined area on the grinding surface of the grinding wheel by the use of a laser microscope; and section area calculation means for calculating the abrasive grain section area for the plurality of abrasive grains within the predetermined area based on the data group.

14. The tangential grinding resistance measuring apparatus as set forth in claim 9, wherein:

the grinding parameters comprise at least one of specific grinding energy (Cp), wheel circumferential speed (V), infeed amount (d) per workpiece revolution, grinding width (b), workpiece rotational speed (v), friction coefficient (μ) between abrasive grains and workpiece, contact length (L) between grinding wheel and workpiece, workpiece density (ρ), specific heat (c) of workpiece, thermal conductivity (k) of workpiece, and thermal distribution coefficient (a) to workpiece; and where the half vertex angle of the conical model is represented by symbol α and where constants are represented by symbols K1 and K2, the tangential grinding resistance (Ft), the grinding heat amount (Q) and the maximum temperature (θmax) are calculated by the following expressions 1, 2 and 3, respectively $$Ft=Cp(vdb/V)+\mu Cp(\pi vdb/2V)\tan\alpha \quad \text{(Expression 1)}$$

$$Q=(FtV)/(Lb) \quad \text{(Expression 2)}$$

$$\theta\max=K1\{L/(\rho ckv)\}^{K2}\times aQ. \quad \text{(Expression 3)}$$

15. The tangential grinding resistance measuring apparatus as set forth in claim 9, wherein the predetermined depth is an infeed depth of the abrasive grain cutting edges.

16. A wheel life judgment apparatus for a grinding wheel in which a grinding wheel layer having abrasive grains bonded with a bond material is formed on a grinding surface, the wheel life judgment apparatus comprising:

section area obtaining means for obtaining an abrasive grain section area of the grinding wheel which is at a predetermined depth from the highest top surface of a plurality of abrasive grains within a predetermined area on the grinding surface of the grinding wheel; and wheel life judgment means for judging the wheel life of the grinding wheel by the comparison of the abrasive grain section area with a threshold value.

* * * * *